United States Patent [19]

Ohashi

[11] Patent Number: 5,006,674

[45] Date of Patent: Apr. 9, 1991

[54] DISTRIBUTOR AND DISTRIBUTOR ROTOR ELECTRODE

[75] Inventor: Yutaka Ohashi, Himeji, Japan

[73] Assignee: Mitsubishi Denki Kabushiki Kaisha, Tokyo, Japan

[21] Appl. No.: 528,641

[22] Filed: May 29, 1990

[30] Foreign Application Priority Data

May 30, 1989 [JP] Japan ..... 1-134734
Jun. 16, 1989 [JP] Japan ..... 1-152185

[51] Int. Cl.[5] ..... H01H 19/00; F02P 7/02

[52] U.S. Cl. ..... 200/19 R; 200/19 DR; 200/267

[58] Field of Search ..... 200/19 R, 19 DC, 19 DR, 200/267

[56] References Cited

U.S. PATENT DOCUMENTS 4,007,342 2/1977 Makino et al. ..... 200/19
4,039,787 8/1977 Hori et al. ..... 200/19 DR X
4,074,090 2/1978 Hayashi et al. ..... 200/19 D
4,135,066 1/1979 Yamanaka et al. ..... 200/19 DR X
4,177,366 12/1979 Kozuka et al. ..... 200/19 D
4,186,286 1/1980 Kuo et al. ..... 200/19 D
4,345,120 8/1982 Sawada et al. ..... 200/19
4,425,485 1/1984 Sone et al. ..... 200/19 DR X
4,833,282 5/1989 Matsumura et al. ..... 200/19 D

FOREIGN PATENT DOCUMENTS 51-38853 10/1976 Japan .

*Primary Examiner*—J. R. Scott
*Attorney, Agent, or Firm*—Sughrue, Mion, Zinn, Macpeak and Seas

[57] ABSTRACT

A distributor for internal combustion engine having a mica layer fixedly provided, or a mica plate bonded by an adhesive agent, at least at one face of a discharging section of a distributor rotor electrode provided in a distributor rotor, the mica layer containing mica material dispersed in an organic resin. The mica layer or mica plate having a large anti-discharge characteristic can suppress generation of noise radio waves resulting from a discharge.

6 Claims, 6 Drawing Sheets

DISTRIBUTOR AND DISTRIBUTOR ROTOR ELECTRODE

BACKGROUND OF THE INVENTION

1. Field of the Invention

This invention generally relates to a distributor for internal combustion engine and a distributor rotor electrode employed therein, and more particularly, to a distributor and a distributor rotor electrode designed to suppress noise radio waves resulting from a spark discharge consequent to the distribution of power.

2. Discription of Related Art

FIG. 1 shows a side elevational view, partially in section, of a conventional distributor for internal combustion engine. A rotrary shaft 1 of the distributor rotates in synchronization with rotation of a crank shaft of the internal combustion engine. A distributor rotor 2 fixed to the rotary shaft 1 is provided with a distributor rotor electrode 3. Also provided are a plurality of lateral electrodes 4 spaced a discharge gap (g) from a rotation orbit of the distributor rotor electrode 3. A contact 6 connected with an ignition coil through a leading wire 5 is pressed in contact with an upper surface of the distributor rotor electrode 3.

In the above structure, every time the distributor rotor electrode 3 comes close to the lateral electrodes 4 in accordance with the rotation of the distributor rotor 2, a high voltage is applied to the lateral electrodes 4 as a result of discharge via the discharge gap (g). This discharge via the discharge gap (g) allows a sequential distribution of power to an ignition plug of each cylinder. At this occasion, the spark discharge in the discharge gap (g) between the distributor rotor electrode 3 and lateral electrodes 4 generates noise radio waves causing radio jamming or interference to radio and television broadcasting, various kinds of radiocummunication system and electronic system, thereby deteriorating S/N ratio.

In order to suppress the generation of noise radio waves discribed above, conventionally, means disclosed in Japanese Patent Publication No. 51-38853 has been employed, which has, as indicated in FIG. 2, a highly resistive layer 7 formed on the surface of the distributor rotor electrode 3 adjacent to the lateral electrodes 4. Such structure as is possessed by the above-discribed means can reduce the strength of electric field of noise radio waves generated at the time of discharge between the distributor rotor electrode 3 and lateral electrodes 4.

Although it is confirmed by the peak detection (SAE) that the conventional distributor for internal combustion engine in the foregoing structure is considerably effective to suppress noise radio waves owing to the highly resistive layer provided in the distributor rotor electrode, the quasi-peak detection (CISPR) of the conventional distributor does not show satisfactory effect. Therefore, the earlier-mentioned radio jamming due to the noise radio waves particularly in FM radio is yet to be solved in the conventional distributor.

Moreover, the highly resistive layer on the front face of the distributor rotor electrode increases radio noises, resulting in unstable discharge. In addition, the highly resistive layer has a drawback to be weak to discharge.

SUMMARY OF THE INVENTION

Accordingly, this invention is devised to solve the above-described disadvantages inherent in the prior art disstributor.

One object of this invention is to provide a distributor and a distributor rotor electrode which is remarkably effective to suppress generation of noise radio waves as measured by the quasi-peak detection.

A further object of this invention is to provide a distributor and a distributor rotor electrode which realizes stable discharge in a discharge gap.

The distributor for internal combustion engine according to this invention is provided with a distributor rotor electrode mounted in a distributor rotor fixed to a rotary shaft which is rotated in synchronization with a crank shaft of the internal combustion engine, and a plurality of lateral electrodes spaced a discharge gap from a rotation orbit of the distributor rotor electrode. Moreover, a mica layer containing mica is formed at least on a part of the surface of the distributor rotor electrode. The mica layer is composed of mica material dispersed in an organic resin such as epoxy resin, silicone resin, etc. Or, it may be possible to bond a mica plate at least on a part of the surface of the distributor rotor electrode by an adhesive agent of silicone resin.

Accordingly, in the distributor of this invention, the generation of noise radio waves accompanying the discharge can be effectively suppressed by the mica layer or mica plate having a large anti-discharge characteristic.

The above and further objects and features of the invention will more fully be apparent from the following detailed description with accompanying drawings.

DESCRIPTION OF THE PREFERRED EMBODIMENTS

Preferred embodiments of this invention wil be discussed hereinbelow in a detailed manner with reference to the accompanying drawings.

Figure 3:
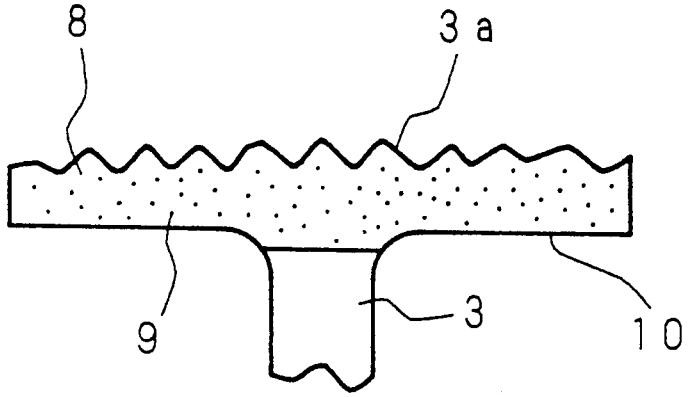
FIG. 3 is a plan view of an essential portion of a first embodiment of this invention.
Figure 4:
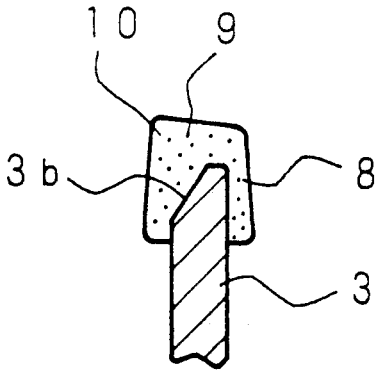
FIG. 4 is a side sectional view of the embodiment of FIG. 3.

FIGS. 3 and 4 are respectively a plan view of an essential portion of a first embodiment of this invention and a side sectional view thereof. According to this invention, for the purpose of stabilizing the discharge, the distributor rotor electrode 3 has notches 3*a* formed in a front periphery thereof confronting to the lateral electrodes, and an inclined face 3*b* at a front end portion thereof. A mica layer 8 is rigidly mounted on the surface of the distributor rotor electrode 3, namely, on the upper and lower faces and the front face of the electrode 3. The mica layer 8 of this embodiment is formed of a powdery mica 9 dispersed and molded within an epoxy resin 10. Epoxy resin may be replaced with silicone resin.

Figure 1:
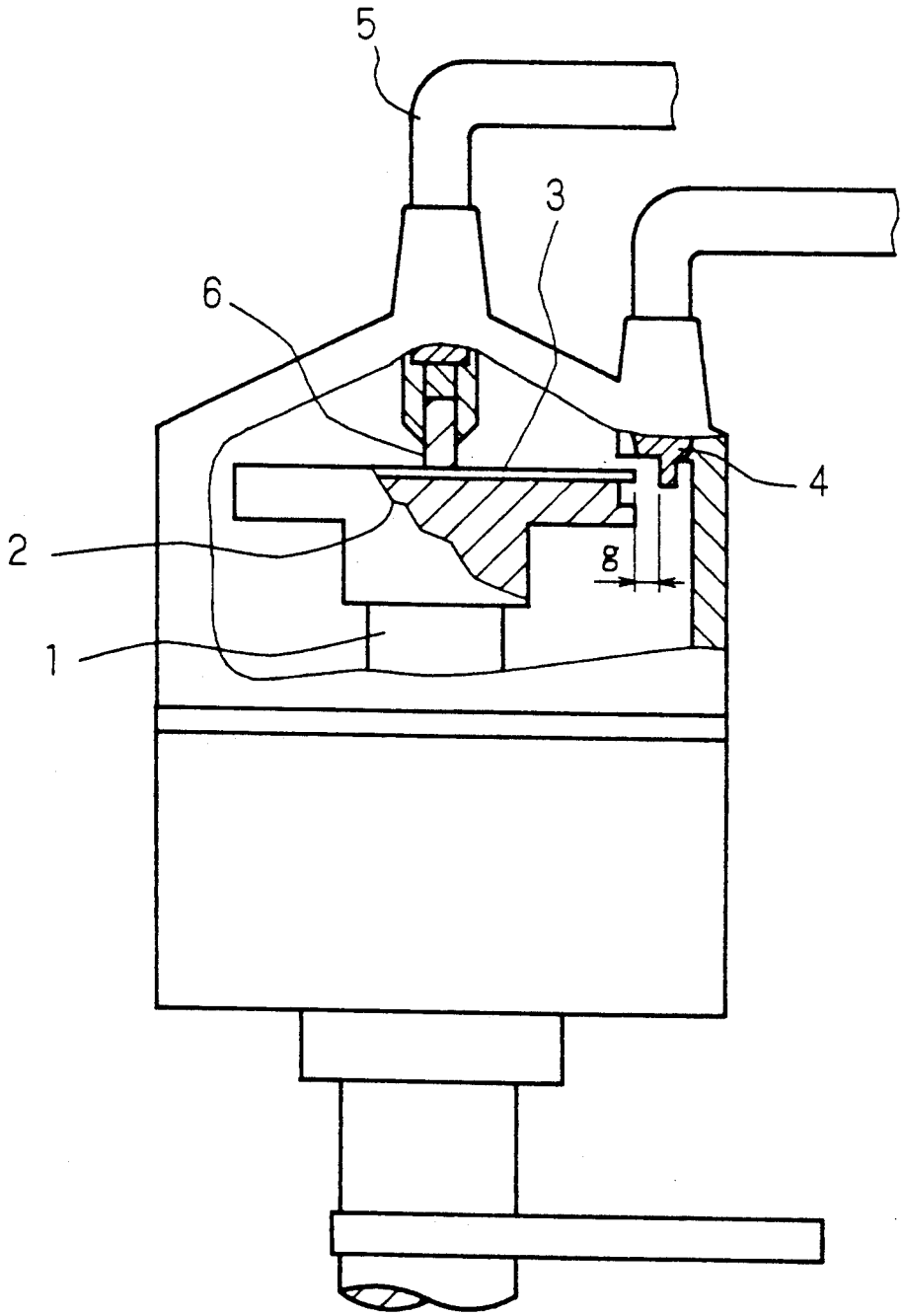
Fig. 1 Prior Art
FIG. 1 is a side elevational view, partially in section, of a conventional distributor for internal combustion engine.
Figure 2:
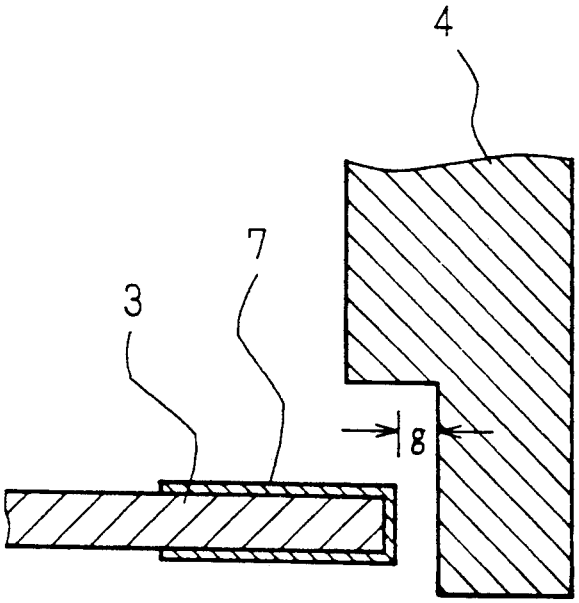
Fig. 2 Prior Art
FIG. 2 is a side sectional view of an essential portion of a conventional distributor for internal combustion engine.

The other constitution is the same as in the conventional distributor shown in FIG. 1.

In the distributor having the above-described structure, the mica layer 8 which exerts large anti-discharge characteristic can suppress the generation of noise radio waves. Accordingly, a remarkable suppressing effect is confirmed through measurement of noise radio waves both by the peak detection (SAE) and by the quasi-peak detection (CISPR). Moreover, the data obtained through measurement of the strength of electric field of noise radio waves for each frequency and hearing test can also support the confirmation of the remarkable suppressing effect.

Figure 5:
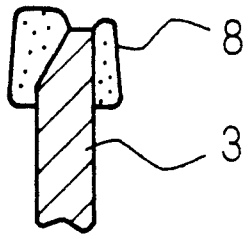
FIG. 5 is a side sectional view of a modification of the first embodiment of this invention.

FIG. 5 is a side sectional view of a modified example of the first embodiment, wherein the mica layer 8 is formed only on the upper and lower faces of the distributor rotor electrode 3, with achieving the same effect.

Figure 6:
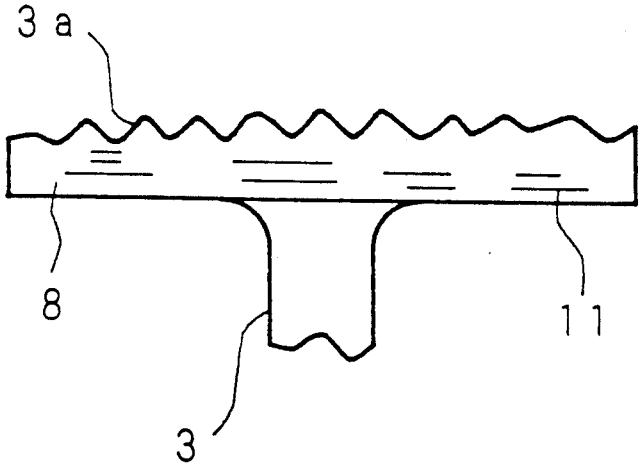
FIG. 6 is a plan view of an essential portion of a second embodiment of this invention.
Figure 7:
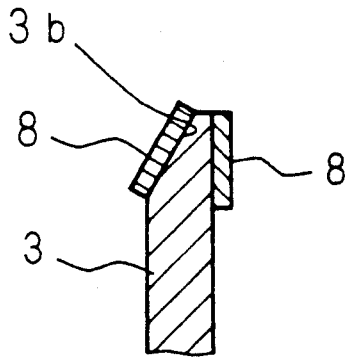
FIG. 7 is a side sectional view of the embodiment of FIG. 6.
Figure 8:
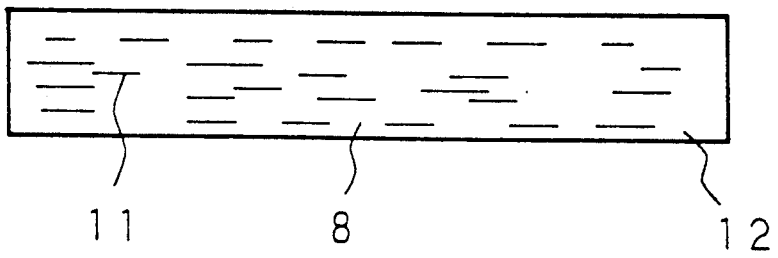
FIG. 8 is a sectional view of a mica layer in the embodiment of FIG. 6.

FIGS. 6 and 7 are respectively a plane view of an essential portion of a second embodiment of this invention and a side sectional view thereof. FIG. 8 is a sectional view of the mica layer 8 according to this second embodiment. In the second embodiment also, the distributor rotor electrode 3 has the peripheral notches 3*a* and inclined face 3*b* at a discharging section thereof, thereby to stabilize the discharge. The mica layer 8 is formed at the opposite faces of the discharging section. As shown in FIG. 8, the mica layer 8 is formed of mica flakes 11 molded by an organic resin 12 composed of epoxy resin or silicone resin. It is to be noted here that although the mica layer 8 is formed at the opposite faces of the discharging section (upper and lower faces) of the distributor rotor electrode 3, it may be provided only at one face of the discharging section of the distribution rotor electrode 3.

Similar to the first embodiment, the distributor of the second embodiment can suppress the generation of noise radio waves beacuse it is fitted with the mica layer 8 having a large anti-discharge characteristic. The suppressing effect of the distributor is made sure through measurement of the noise radio waves by the peak detection (SAE) and quasi-peak detection (CISPR). Further, the remarkable suppressing effect is also confirmed from the data obtained through measurement of the strength of electric field of noise radio waves for each frequency and hearing test.

Figure 9:
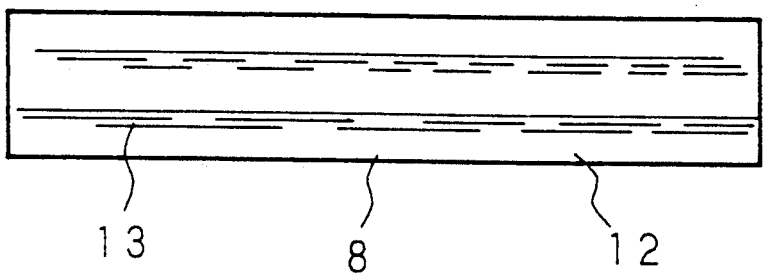
FIG. 9 is a sectional view of a mica layer in a third embodiment of this invention.

FIG. 9 is a sectional view of the mica layer 8 in a third embodiment of this invention. According to the third embodiment, the mica layer 8 is formed of a plurality of laminated synthetic mica sheets 13 which are molded by the organic resin 12 composed of epoxy resin or silicone resin.

Figure 10:
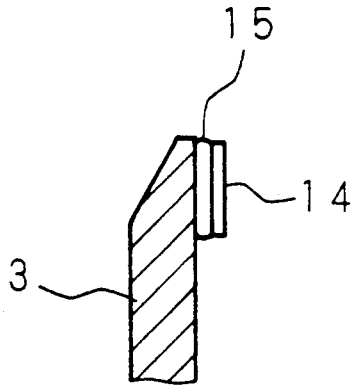
FIG. 10 is a side sectional view of an essential portion of a fourth embodiment of this invention.

FIG. 10 is a side sectional view of an essential portion of a fourth embodiment of this invention, in which a mica plate 14 is fixedly bonded by a silicone resin adhesive agent 15 to one face of the discharging section of the distributor rotor electrode 3. The noise radio waves can be suppressed in this fourth embodiment similarly to the other aforementioned embodiments, with the stable discharge secured.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A distributor for an internal combustion engine, comprising:

a rotary shaft which rotates in synchronization with a crank shaft of the internal combustion engine;

a distributor rotor fixed to said rotary shaft;

a distributor rotor electrode provided in said distributor rotor; and a plurality of circumferentially spaced lateral electrodes spaced a discharge gap from a rotation orbit of said distributor rotor electrode;

wherein a noise suppressing mica layer containing mica is formed at least on a part of the surface of a radially outermost portion of said distributor rotor electrode, and wherein said mica layer is formed of particulate mica material uniformly dispersed in an organic resin.

2. A distributor for an internal combustion engine as set forth in claim 1, wherein said distributor rotor electrode has an outer face formed with notches confronting said lateral electrodes, and a confronting edge portion formed with a bevel or slope.

3. A distributor for an internal combustion engine as set forth in claim 1, wherein said mica layer is formed at every face of a discharging section of said distributor rotor electrode.

4. A distributor for an internal combustion engine as set forth in claim 1, wherein said mica layer is formed at one face of a discharging section of said distributor rotor electrode.

5. A distributor for an internal combustion engine as set forth in claim 1, wherein said organic resin is one selected from a group comprising epoxy resin and silicone resin.

6. A distributor rotor electrode provided in a distributor rotor of a distributor, comprising:

a noise suppressing mica layer containing mica and being provided at least at one face of a discharging section of said electrode, wherein said mica layer is formed of particulate mica material uniformly disperesed in an organic resin.

* * * * *